US006582110B1

(12) United States Patent
Negri et al.

(10) Patent No.: US 6,582,110 B1
(45) Date of Patent: Jun. 24, 2003

(54) MOTOR-VEHICLE LIGHT

(75) Inventors: Alessandro Negri, Turin (IT); Maria Teresa Dalmasso, Vinovo (IT)

(73) Assignee: Automotive Lighting Italia SpA, Turin (IT)

( * ) Notice: Subject to any disclaimer, the term of this patent is extended or adjusted under 35 U.S.C. 154(b) by 9 days.

(21) Appl. No.: 09/584,391

(22) Filed: Jun. 1, 2000

(30) Foreign Application Priority Data

Aug. 11, 1999 (EP) ..... 99830522

(51) Int. Cl.[7] ..... F21V 9/00

(52) U.S. Cl. ..... 362/516; 362/517; 362/298; 362/299; 362/297; 362/348; 362/344

(58) Field of Search ..... 362/517, 518, 362/510, 298, 299, 300, 346, 348, 296, 297, 514

(56) References Cited

U.S. PATENT DOCUMENTS 1,336,967 A * 4/1920 Laird ..... 362/517
1,641,714 A * 1/1927 Whalen ..... 362/517
1,818,875 A * 8/1931 Wardell ..... 362/517
5,836,668 A * 11/1998 Ishikawa et al. ..... 362/61
6,244,731 B1 * 6/2001 Koiko et al. ..... 362/297
6,280,064 B1 * 8/2001 Sato et al. ..... 362/348

FOREIGN PATENT DOCUMENTS

EP 0 766 037 A 4/1997
EP 0 886 101 A 12/1998
IT 0886101 A2 * 12/1998 ..... 362/517

* cited by examiner

*Primary Examiner*—Sandra O'Shea
*Assistant Examiner*—Anabel Ton
(74) *Attorney, Agent, or Firm*—Sughrue Mion, PLLC

(57) ABSTRACT

A motor-vehicle light comprises a hollow body with a transparent element facing a main reflective structure which reflects the light rays coming from a source arranged at one side of the main reflective structure towards the transparent element, an auxiliary reflective element being associated with the light source. The main reflective structure has a shell-like configuration, which is visible from the outside since the transparent element has no optical elements. The shell-like configuration comprises a plurality of optically active surface sectors alternated to connecting walls which are substantially radial with respect to the source. The optically active sectors are geometrically generated by translation or rotation of a family of generating curves each having undulations with a pitch substantially lower than the pitch of the distribution of the optically active surface sectors.

14 Claims, 3 Drawing Sheets

8
10
10a
10b
11
12
12a
13
VII

MOTOR-VEHICLE LIGHT

BACKGROUND OF THE INVENTION

The present invention relates to motor-vehicle lights of the type comprising:

- a hollow body having a front aperture covered by a transparent element and a main reflective structure facing the transparent element, and
- a light source located on one side of the hollow body, to which there is associated an auxiliary reflective element, to direct light rays emitted by the source towards the main reflective structure, which is adapted to reflect them towards the transparent element, so as to obtain a light beam having predetermined characteristics coming out from the transparent element.

SUMMARY OF THE INVENTION

A motor-vehicle light of the above indicated type is disclosed for example in European Patent Application EP-A-0 886 101. This known light has a number of characteristics aiming to the object of obtaining a minimum bulk of the light in a direction orthogonal to the transparent element, while ensuring that a light beam having the required characteristics is obtained at the output, even in case the light is positioned at an area of the vehicle which is not ideal for obtaining a good rear illumination, such as at a side edge of the rear portion of the motor-vehicle.

The present invention starts from the above mentioned known light and has as its main object that of improving this light in order to obtain new and unique aesthetical effects, both in the condition of light turned off and in the condition of light turned on, which can be exploited to confer unique aesthetical features to the motor-vehicle.

In order to achieve this object, the invention provides a light having the features indicated at the beginning and further characterized in that:

- the transparent element has at least a substantial part thereof with no optical elements, so that said main reflective structure is visible from the outside,
- said main reflective structure has a shell-like configuration, with a plurality of optically active surface sectors alternated to connecting walls which are substantially radial relative to the source and therefore appear as non-illuminated areas to the viewer, thus ensuring an optical effect characterized by illuminated sectors alternated to non-illuminated sectors,
- the above mentioned optically active surface sectors are geometrically generated by translation or rotation from a family of respective generating curves each having undulations with a pitch substantially lower than the pitch of the distribution of the optically active surface sectors.

In the light according to the invention, similarly to the light disclosed in EP-A-0 886 101, the light source with the auxiliary reflective element associated thereto are partially or totally hidden from view. However, in the case of the present invention, the transparent element of the light, at least for a substantially portion thereof, has no optical elements (prisms or lenses) so that the surface of the main reflective structure is visible from the outside. This constitutes an important difference of the light according to the invention with respect to the lights according to the conventional art, in which the transparent element is shaped with prisms or lenses in order to confer predetermined characteristics to the light beam reflected towards the transparent element.

Naturally, since the light according to the invention has no optical elements on the transparent element which are able to confer the required characteristics to the light beam, this function must be obtained by different means. Just to this end, the above mentioned undulations are provided in the curves generating the optically active surfaces sectors. Due to this features, the main reflective structure reflects a light beam which already has the required vergence characteristics towards the transparent element.

In the preferred embodiment, each optically active surface sector is geometrically generated by linear translation of a conic curve (i.e a curve corresponding to the intersection between a plane and a conical surface) having a focus located in proximity of the light source. The above mentioned conic curve may be for example a parabola. In a variant each optical active surface sector is geometrically generated by rotation of a conic curve having a focus located in proximity of the light source.

Preferably, each generating curve is oriented so as to give rise to an optically active surface sector which reflects the rays in the desired direction. In this manner, the various portions of the main reflective structure can reflect the beam according to different angular ranges, so as to obtain a light beam having the required characteristics coming out of the light, notwithstanding the transparent element has no optical elements.

In a further embodiment, each optically active surface sector is geometrically generated by translating or rotating the respective generating curve according to an undulated path. In this case, the main reflective structure thus has both the undulations deriving from the undulated profile of the generating curve, and the undulations, substantially orthogonal to the former, deriving from the undulated path generating the surface.

A further feature of the preferred embodiment of the invention lies in that said auxiliary reflective element is in form of a semi-ellipsoid having the light source in proximity of the focus which is closer to the apex of the semi-ellipsoid. In this case, if the curves generating the optically active surface sectors are parabolas, each generating parabola has the focus located between the two foci of the auxiliary reflective element.

Alternatively, the auxiliary reflective element may have a shape chosen among the paraboloid shape, the cylindrical shape generated by translation of an ellipse, or a complex shape including geometrically different portions.

A further possible feature of the invention lies in that the transparent element, although having a substantial portion with no optical element, anyway has a further minor portion shaped with lenses or prisms. For example, this portion may be a peripheral portion of the light.

A further feature of the preferred embodiment of the invention lies in that it comprises a coloured filter located between the source and auxiliary reflective element unit and the main reflective structure. This coloured filter may also have prisms or a matrix of micro-lenses or Fresnel lenses.

Finally, according to a further preferred feature of the invention, the light source is a conventional lamp having one or more filaments, of a type known per se, the filaments being adapted to be used selectively to obtain different functions by the same light. For instance, the same light can be used as tail light or stop light.

Further features and advantages of the invention will become apparent from the description which follows with reference to the annexed drawings, given purely by way of non limiting example, in which:

DETAILED DESCRIPTION OF THE INVENTION

Figure 1:
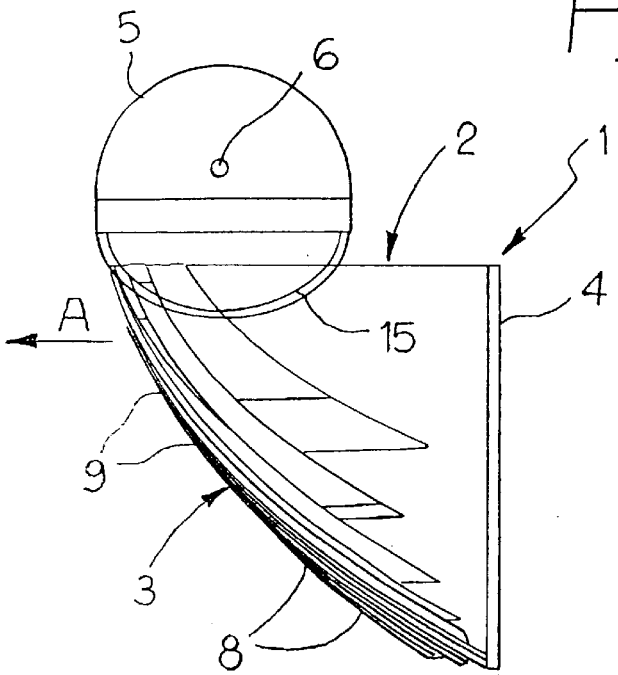
FIG. 1 is a cross-sectional view of a preferred embodiment of the light according to the invention in a vertical plane parallel to the longitudinal direction of the motor-vehicle (with reference to the mounted condition of the light)

With reference to the drawings, numeral 1 generally designates a motor-vehicle light, which can be used for example on the rear part of the motor-vehicle has a tail light and/or stop light or fog guard light, or reverse light, or direction light.

Light 1 comprises a body 2 including a main reflector structure 3 in front of which a transparent element 4 is located. On one side of the main reflector structure 3 an auxiliary reflector element 5 is located associated with a light source 6. Elements 3, 4, 5 are preferably made of plastic material. The reflective elements 3, 5 are varnished and/or metallized in order to confer the required reflective characteristics thereto.

The example illustrated in the drawings refers to the case of the light whose body 2 is substantially elongated in one direction and is mounted on the motor-vehicle with its direction of greater extension arranged vertically. Naturally, however, the invention is applicable also to lights having a different proportioning and orientation, such as front lights for motor-vehicles.

FIG. 1 relates, as already indicated, to a cross-section in a vertical plane parallel to the longitudinal direction of the vehicle. In this figure, arrow A designates the direction of movement of the motor-vehicle.

Figure 2:
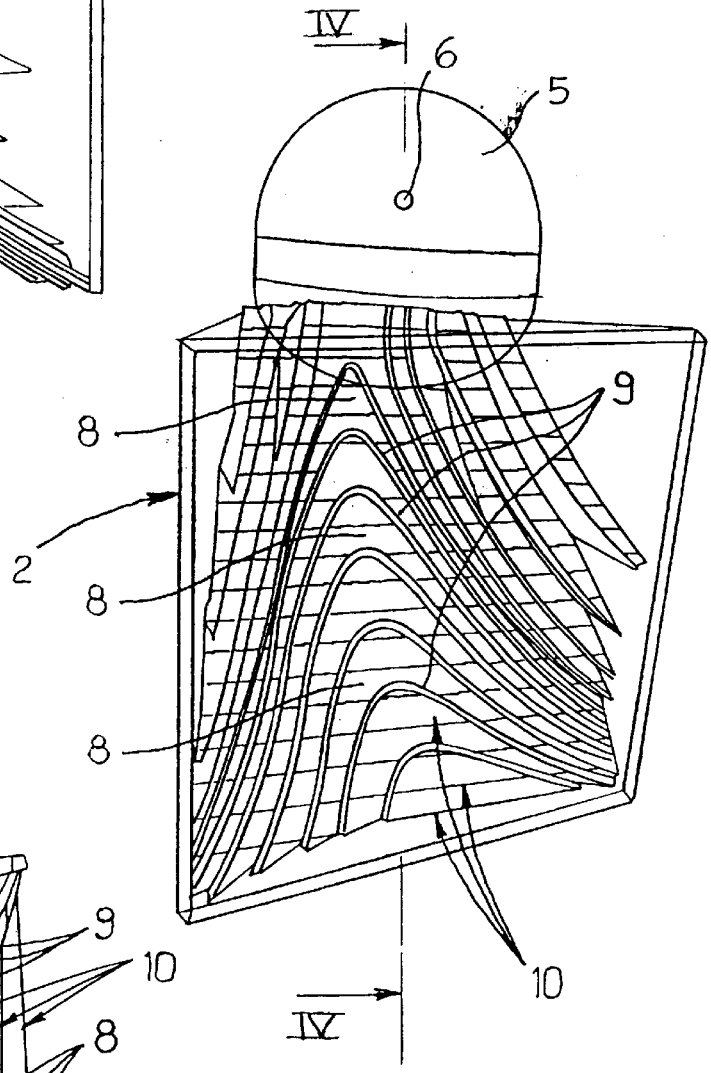
FIG. 2 is a front view of the light of FIG. 1.

As also already indicated, the transparent element 4 is substantially clear, i.e. it has no lenses and/or prisms throughout its whole extension or anyhow throughout a prevailing portion thereof, so that the surface of the reflective structure 3 is visible from the outside. FIG. 2 shows the configuration of this reflective structure 3 as it appears viewed from the outside.

Figure 4:
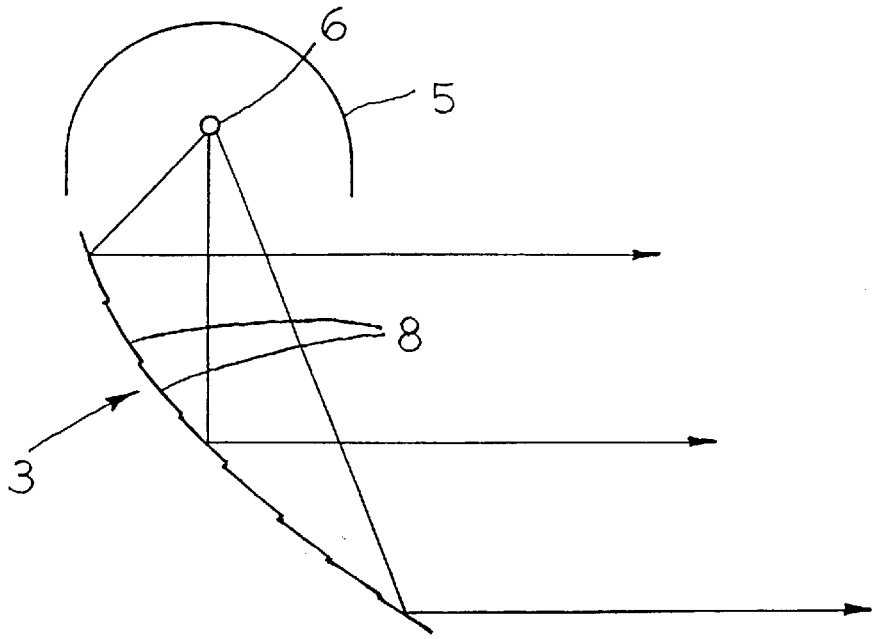

As already indicated, the main reflective structure 3 reflects the light rays coming from the source 6—auxiliary reflected element 5 unit towards the outside. As visible in FIGS. 4, 5, the reflective structure 3 reflects both light rays directly coming from the source and light rays reflected by the auxiliary reflective element 5 (see FIG. 5) towards the outside of the light. Therefore, the combined use of the two reflective elements 3, 5 ensures maximum light efficiency. At the same time, the auxiliary reflective element 5 with the associated light source 6 are hidden from view.

In the preferred embodiment of the invention, the light source 6 is a conventional lamp for motor-vehicles, however it is possible to provide for the use of other types of source, such as discharge lamps, leds, neon lights, both with white light and coloured light. The use of a lamp for instance with double filament is particularly interesting, since it is possible to provide for turning selectively on the two filaments in order to obtain different functions by the same light (for instance to be used both as a tail light and stop light).

Figure 5:
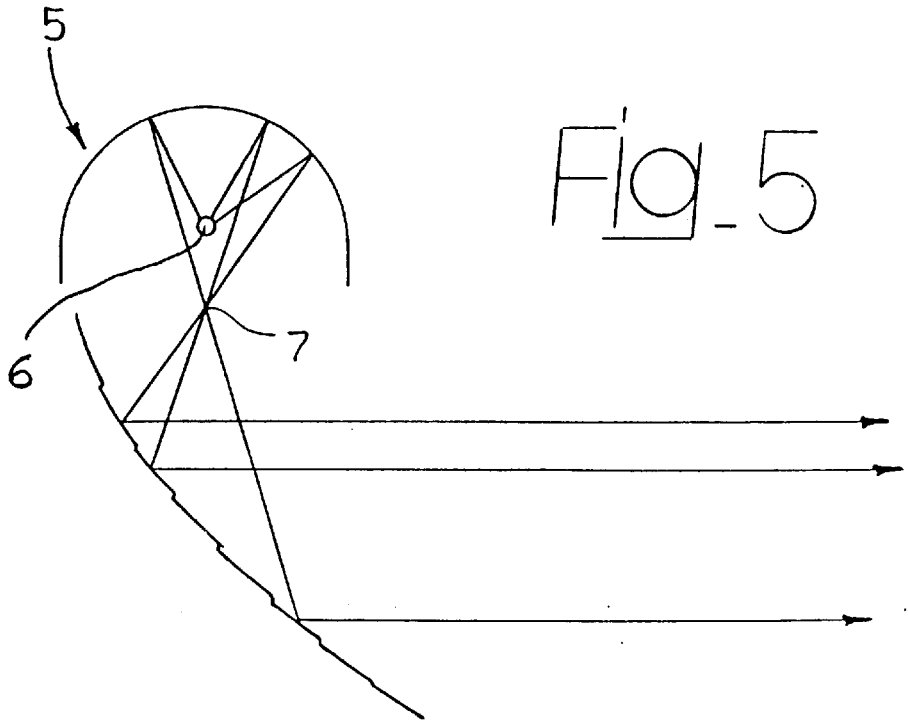

Also in the case of the preferred embodiment, the auxiliary reflective element 5 is in form of a semi-ellipsoid, with light source 6 located in proximity of the focus of the semi-ellipsoid which is closer to the apex of the latter. In this manner, the light rays reflected by the auxiliary reflective element 5 all intersect each other at a point 7 substantially coincident with the second focus of the semi-ellipsoid constituting the auxiliary element 5 (FIG. 5).

Figure 3:
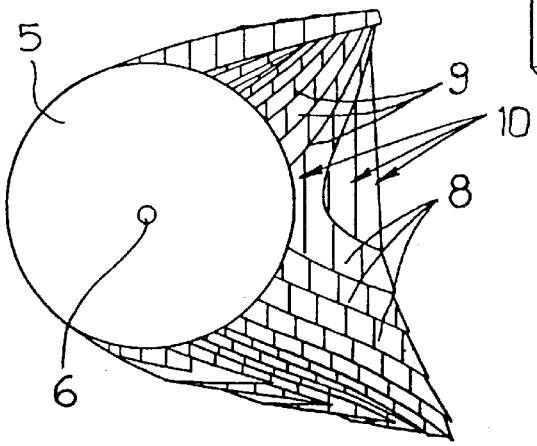
FIG. 3 is a top view of the light of FIG. 1, FIGS. 4, 5 show a cross section taken along line IV—IV of FIG. 2 and show the principle of the operation of the light according to the invention.

As clearly apparent from FIGS. 1–3, the main reflective structure 3 has a shell-like configuration, with a plurality of optical active surface sectors 8 alternated to connecting walls 9 which are substantially radial with respect to the source 6 and therefore appear as non illuminated areas to the viewer thus generating an optical effect characterized by illuminated sectors alternated to dark sectors.

As already illustrated above, the optically active surface sectors 8 are geometrically generated by translation or rotation from a family of generating curves each having undulations 10 with a pitch substantially lower than the pitch of distribution of the optically active surface sectors 8.

Figures 6, 7:
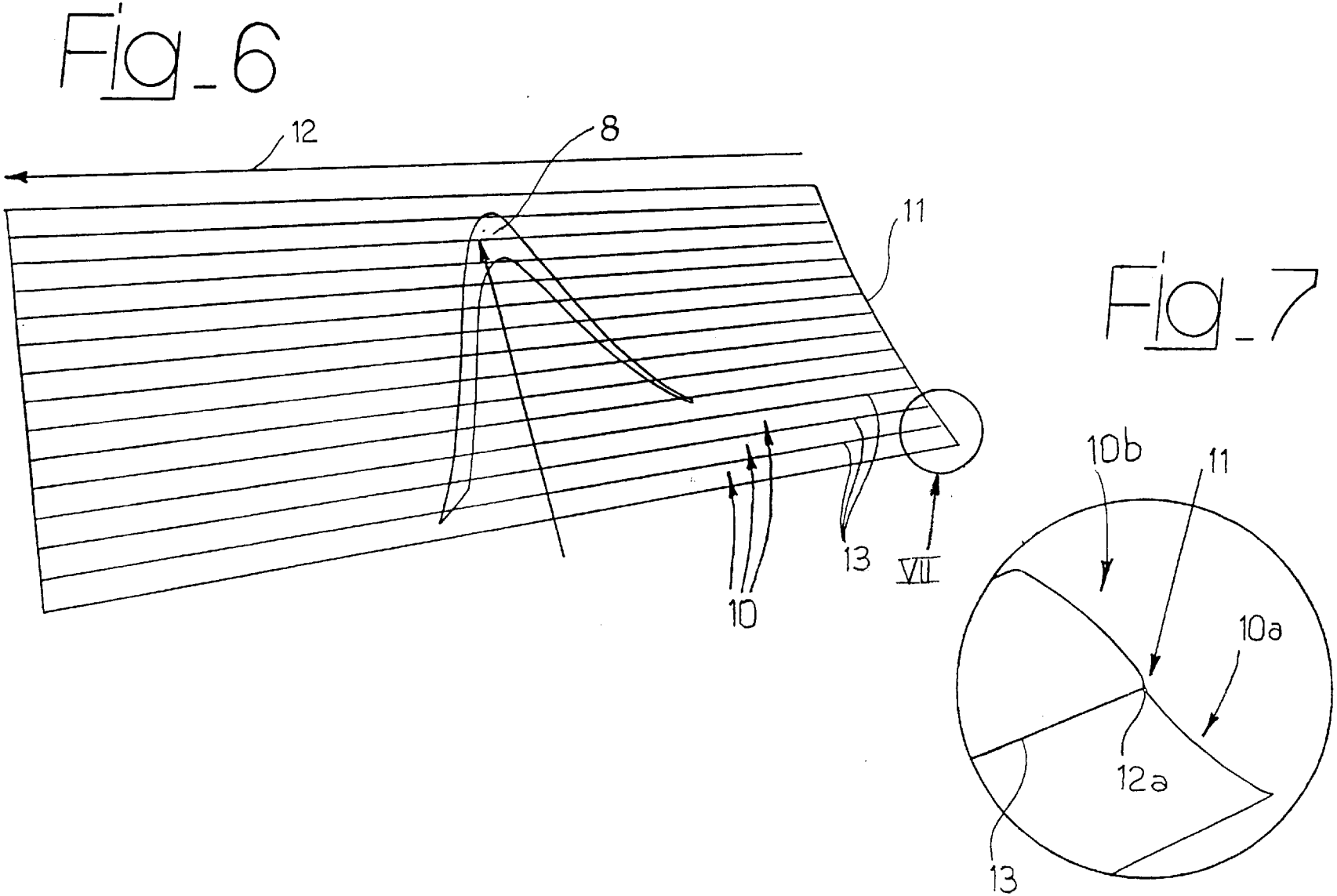
FIG. 6 is a perspective diagrammatic view which shows the way by which the main reflective structure of the light according to the invention is generated.
FIG. 7 is a perspective view at an enlarged scale of the detail designated by VII in FIG. 6.

By way of example, FIG. 6 shows how the surface of a specific optically active surface sector 8 is generated. The example illustrated in FIG. 6 refers to the case in which a single generating curve is used which in the specific case is a parabola 11. The surface of sector 8 is located by translating parabola 11 along a rectilinear direction 12. The intersection of the surface thus generated with a concave surface defining the overall bulk of the reflective structure 3 giver rise to an optically active surface sector 8. As visible in FIGS. 6, 7, actually parabola 11 has an undulated profile, with concave semi-waves 10*a* alternated to convex semi-waves 10*b* through curvature reversing points 12*a*, which give rise to undulation lines 13 in the surface generated by translating parabola 11.

As already indicated in the foregoing, each surface sector 8 can be generated by a different line 11, having different features, so as to reflect the light rays according to a different angular range.

As shown in FIG. 7, each of the surface portions corresponding to semi-waves 10*a* or 10*b* reflect light rays by causing them to converge (semi-wave 10*a*) or diverge (semi-wave 10*b*) so as to obtain compressively a light beam having the required vergence characteristics.

Due to this feature, it is thus possible to obtain the function which is conventionally fulfilled by the prisms and/or lenses provided on the transparent element 4. In the case of the present invention instead this element 4 is substantially clear, so as to leave the surface of the reflective structure 3 visible from the outside thus obtaining unique aesthetical features deriving from the alternation of illuminated sectors and non illuminated sectors.

As also already indicated, line 11 which is used to generate each optically active surface sector 8 can be a curve different from a parabola. For example, it can be a conic curve of any other type.

In general, whichever is the type of conic curve chosen to generate each surface sector 8, this conic curve is chosen so as to have one focus in proximity of the light source 6. In the specific case of a parabola, as the parabola 11 shown in FIG. 6, this parabola is shaped and oriented so that it has its focus substantially in proximity of source 6. In the case that the auxiliary reflective element 5 is a semi-ellipsoid, as already indicated, the focus of the parabola is located at a point intermediate between the two foci of the semi-ellipsoid constituting the auxiliary reflective element. Therefore, in the present description and in the following claims, when it is made reference to the position of the focus of the parabola as substantially adjacent to the light source, it is covered by this definition also the case in which this focus is actually at a point intermediate between the two foci of the semi-ellipsoid constituting the auxiliary reflective element. Due to this feature, the main reflective structure 3 ensures a good compromise in order to have an efficient reflection both of light rays coming directly from the source (FIG. 4) and of light rays reflected by the auxiliary reflective element 5.

From the foregoing description, it is clearly apparent that the light according to the invention is able to give rise to new and unique aesthetical features, due to the particular configuration of the main reflective structure 3, which gives rise to illuminated sectors alternated to non illuminated sectors and due to the substantial transparency of element 4. At the same time, the undulations provided in the conic line 11 which is used to generate each optically active surface sector 8, provide the required characteristics of the light beam coming out of the light, with no need of lenses or prisms on the transparent element 4.

Naturally, as also already indicated, each surface sector 8 may be generated starting from a conic line 11 by rotation of this line, rather than by straight translation.

A further possibility is that of obtaining the surface sector 8 by translating the conic line 11 according to a path 12 which is undulated rather than rectilinear, so as to obtain a second series of undulations orthogonal to undulations 10.

As also already indicated, the auxiliary reflective element 5 is preferably a semi-ellipsoid, with the source 6 located at the focus closer to the apex of the semi-ellipsoid. Typical dimensions include a spacing of the apex of the semi-ellipsoid from the light source of 30 mm and a distance between the two foci of the semi-ellipsoid of 10 mm. However, it is possible to provide different geometries for the auxiliary reflector 5, such a paraboloid, generated by revolution of a parabola, or a cylindroid, generated by translating an ellipse. It is also possible to provide a complex geometry, including portions having different geometries, such as having elliptical and parabolic sections in different planes. It is also possible to provide an auxiliary reflector 5 having aesthetical decorations or designs on its surface which once reflected towards the main reflective structure 3 generate further aesthetical features. As also already, the transparent element 4 is substantially deprived of prisms or lenses, but it may have a peripheral area with lenses and/or prisms to obtain additional aesthetical effects.

Finally, the light according to the invention can be provided with a coloured filter 15 for instance interposed between source 6 and the main reflective structure 3 (FIG. 1). This element can be visible, or partially or totally hidden.

Naturally, while the principle of the invention remains the same, the details of construction and the embodiments may widely vary with respect to what has been described and illustrated purely by way of example, without departing from the scope of the present invention.

What is claimed is:

1. Motor-driven vehicle light comprising:

a hollow body with a front aperture covered by a transparent element, and a main reflective structure facing the transparent element, and a light source located on one side of the hollow body, to which there is associated an auxiliary reflective element, to direct light rays emitted by the source towards the main reflective structure, which reflects the light rays towards the transparent element, so as to obtain a light beam having predetermined characteristics coming out of said transparent element, wherein:

the transparent element has at least a substantial part thereof with no optical elements, so that said main reflective structure is visible from the outside, said main reflective structure has a shell-like configuration, with a plurality of optically active surface sectors alternated to connecting walls which are substantially radial with respect to the source, so that they appear as non-illuminated areas to the viewer, thus generating an optical effect characterized by illuminated sectors alternated to non-illuminated sectors, each optically active surface sector is geometrically generated by translation or rotation of a generating curve having undulations with a pitch substantially lower than the pitch of the distribution of each optically active surface sector, each optically active surface sector is geometrically generated by rectilinear translation of a conic curve having a focus located in proximity of the light source, each optically active surface sector is geometrically generated by rectilinear translation of a parabola, and the parabola generating each optically active sector has a focus located between the two foci of the auxiliary reflective element.

2. Light according to claim 1, wherein the above mentioned auxiliary reflective element has a shape selected from the group consisting of a paraboloid shape, a cylindrical shape generated by translation of an ellipse, and a complex shape including geometrically different portions.

3. Light according to claim 1, wherein the transparent element has a portion thereof shaped with lenses or prisms.

4. Light according to claim 3, wherein the portion shaped with lenses or prisms is a peripheral portion of said transparent element.

5. Light according to claim 1, wherein it comprises a coloured filter arranged between the source an auxiliary reflective element unit and the main reflective structure.

6. Light according to claim 5, wherein the coloured filter has prisms or a matrix of microlenses or Fresnel lenses.

7. Lights according to claim 1, wherein the light source is a conventional lamp with one or more filaments which can be used selectively to obtain different functions, or it is a discharge lamp, a led, a neon light, operating with white or coloured light.

8. Motor-driven vehicle light comprising:

a hollow body with a front aperture covered by a transparent element, and a main reflective structure facing the transparent element, and a light source located to one side of the hollow body outside the hollow body so as not to be visible through the transparent element, an auxiliary reflective element partially surrounding the light source to direct light rays emitted by the source towards the main reflective structure, which reflects the light rays towards the transparent element, so as to obtain a light beam having predetermined characteristics coming out of said transparent element, wherein:

the transparent element has at least a substantial part thereof with no optical elements, so that said main reflective structure is visible form the outside, said main reflective structure has a shell-like configuration, with a plurality of optically active surface sectors alternated to connecting walls which are substantially radial with respect to the source, so that they appear as non-illuminated areas to the viewer, thus generating an optical effect characterized by illuminated sectors alternated to non-illuminated sectors, each optically active surface sector is geometrically generated by translation or rotation of a generating curve having undulations with a pitch substantially lower than the pitch of the distribution of each optically active surface sector, wherein each optically active surface sector is geometrically generated by rectilinear translation of a conic curve having a focus in proximity of the light source, wherein each optically active surface sector is geometrically generated by rectilinear translation of a parabola, and wherein the parabola generating each optically active sector has a focus located between the two foci of the auxiliary reflective element.

9. Light according to claim 8, wherein the above mentioned auxiliary reflective element has a shape selected from the group consisting of a paraboloid shape, a cylindrical shape generated by translation of an ellipse, and a complex shape including geometrically different portions.

10. Light according to claim 8, wherein the transparent element has a portion thereof shaped with lenses or prisms.

11. Light according to claim 10, wherein the portion shaped with lenses or prisms is a peripheral portion of said transparent element.

12. Light according to claim 8, wherein it comprises a coloured filter arranged between the source and auxiliary reflective element unit and the main reflective structure.

13. Light according to claim 12, wherein the coloured filter has prisms or a matrix of microlenses or Fresnel lenses.

14. Light according to claim 8, wherein the light source is a conventional lamp with one or more filaments which can be used selectively to obtain different functions, or it is a discharge lamp, a led, a neon light, operating with white or coloured light.

* * * * *